US005344349A

United States Patent [19]

Meisenburg et al.

[11] Patent Number: 5,344,349

[45] Date of Patent: Sep. 6, 1994

[54] SURFACING MARINE DRIVE WITH CONTOURED SKEG

[75] Inventors: Gary L. Meisenburg; Phillip D. Magee, both of Stillwater, Okla.

[73] Assignee: Brunswick Corporation, Lake Forest, Ill.

[21] Appl. No.: 83,702

[22] Filed: Jun. 25, 1993

Related U.S. Application Data

[63] Continuation-in-part of Ser. No. 889,495, May 27, 1992, Pat. No. 5,230,644, and Ser. No. 889,530, May 27, 1992, Pat. No. 5,249,995.

[51] Int. Cl.[5] ..... B63H 5/10

[52] U.S. Cl. ..... 440/80; 440/88; 440/66

[58] Field of Search ..... 440/66, 75–83, 440/900, 88, 89; 114/67 A, 67 R, 274, 162; 123/195 P

[56] References Cited

U.S. PATENT DOCUMENTS

| | | | |
|---|---|---|---|
| 2,847,967 | 8/1958 | Kiekhoefer | 440/78 |
| 2,890,672 | 6/1959 | Boericke, Jr. | 114/274 |
| 3,164,121 | 1/1965 | Alexander, Jr. | 440/88 |
| 3,240,180 | 3/1966 | Byrd | 440/78 |
| 3,745,964 | 7/1973 | Henrich | 440/66 |
| 3,952,686 | 4/1976 | Pichl | 115/17 |
| 3,976,027 | 8/1976 | Jones, Sr. | 440/88 |
| 4,295,835 | 10/1981 | Mapes et al. | 440/78 |
| 4,510,879 | 4/1985 | Weaver et al. | 114/162 |
| 4,630,719 | 12/1986 | McCormick | 192/21 |
| 4,636,175 | 1/1987 | Frazzell et al. | 440/88 |
| 4,679,682 | 7/1987 | Gray, Jr. et al. | 192/21 |
| 4,764,135 | 8/1988 | McCormick | 440/83 |
| 4,790,782 | 12/1988 | McCormick | 440/61 |
| 4,792,315 | 12/1988 | Karrasch et al. | 440/83 |
| 4,795,382 | 1/1989 | McCormick | 440/81 |
| 4,832,635 | 5/1989 | McCormick | 440/78 |
| 4,832,636 | 5/1989 | McCormick | 440/80 |
| 4,863,406 | 9/1989 | Bland et al. | 440/83 |
| 4,869,121 | 9/1989 | Meisenburg | 440/80 |
| 4,869,694 | 9/1989 | McCormick | 440/83 |
| 4,871,334 | 10/1989 | McCormick | 440/89 |
| 4,897,058 | 1/1990 | McCormick | 440/80 |
| 4,900,281 | 2/1990 | McCormick | 440/78 |
| 4,993,848 | 2/1991 | John et al. | 440/78 |

*Primary Examiner*—Edwin L. Swinehart

*Attorney, Agent, or Firm*—Andrus, Sceales, Starke & Sawall

[57] ABSTRACT

A marine drive (10) has two counter-rotating surface operating propellers (12 and 14). The upper end (302) of the leading edge (288) of the skeg (194) is spaced forwardly of the lower end (310) of the trailing edge (306) of the skeg (194) by a horizontal distance greater than the horizontal length of the torpedo (188), for full rudder control. The skeg (194) has a first zone (318) with outer surface profiles (12P–15P) which are continuous and define continuous skeg sidewalls (320, 322) therealong. The skeg (194) has a second zone (324) above the first zone (318) and with outer surface profiles (9P–11P) along horizontal cross-sections, which profiles are discontinuous and define skeg sidewalls with openings (192, 193) therein. The horizontal cross-sections along the second zone (324) have discontinuous gaps (332, 333, 336) therein defining a cored passage (196) within the skeg (194) communicating with the openings (192, 193) in the sidewalls (320, 322). The skeg (194) has a third zone (338) above the second zone (324) and with outer surface profiles (8P) along horizontal cross-sections, which outer surface profiles define continuous skeg sidewalls (320, 322) along the third zone (338). The horizontal cross-sections along the third zone (338) have gaps (340) therein defining the continuation of the cored passage (196) upwardly within the skeg (194) and communicating with the torpedo portion (188 at 198).

10 Claims, 6 Drawing Sheets 8P
9P
10P
11P
12P
13P
14P
15P
340
196
288
348
326
193
192
346
332
350
344
342
328
334
330
336
322
320
354
306
352
194

SURFACING MARINE DRIVE WITH CONTOURED SKEG

CROSS REFERENCE TO RELATED APPLICATIONS

This application is a continuation-in-part of allowed U.S. application Ser. No. 07/889,495, filed May 27, 1992 now U.S. Pat. No. 5,230,644, and allowed U.S. application Ser. No. 07/889,530, filed May 27, 1992, now U.S. Pat. No. 5,249,995 incorporated herein by reference.

BACKGROUND AND SUMMARY

The invention relates to a marine drive having two counter-rotating surfacing operating propellers.

The invention arose during development efforts directed toward a marine drive enabling increase top end boat speed. Surfacing drives for eliminating torpedo drag are known in the art, for example U.S. Pat. No. 4,871,334, column 3, lines 35+.

In one aspect of the present invention, the drive housing is provided with a skeg extending downwardly from the torpedo portion and having a forward leading edge with upper and lower ends, and an aft trailing edge with upper and lower ends, wherein the upper end of the leading edge is spaced forwardly of the lower end of the trailing edge by a horizontal distance greater than the horizontal length of the torpedo portion, for full rudder control.

In another aspect, the skeg has a first zone with outer surface profiles along horizontal cross-sections, the outer surface profiles being continuous along the first zone and defining continuous skeg sidewalls therealong. The skeg has a second zone above the first zone and with outer surface profiles along horizontal cross-sections, the outer surface profiles along the second zone being discontinuous and defining skeg sidewalls with an opening therein. The horizontal cross-sections along the second zone having the discontinuous gaps therein define a cored passage within the skeg communicating with the openings in the sidewalls. The openings in the sidewalls provide water inlets, and the cored passage provides a water passage extending upwardly in the housing. The torpedo portion has a third zone above the second zone and with outer surface profiles along horizontal cross-sections, the outer surface profiles along the third zone being continuous and defining continuous skeg sidewalls along the third zone. The horizontal cross-sections along the third zone have gaps therein defining the continuation of the cored passage upwardly within the skeg and communicating with the torpedo portion.

In another aspect, the skeg has a forward leading edge, and right and left sidewalls extending from the leading edge rearwardly to respective right and left sharp trailing edges providing a sharp break-off releasing water flowing therepast and minimizing water curving back therearound including at the surface below the propeller hubs.

DETAILED DESCRIPTION

Figure 1:
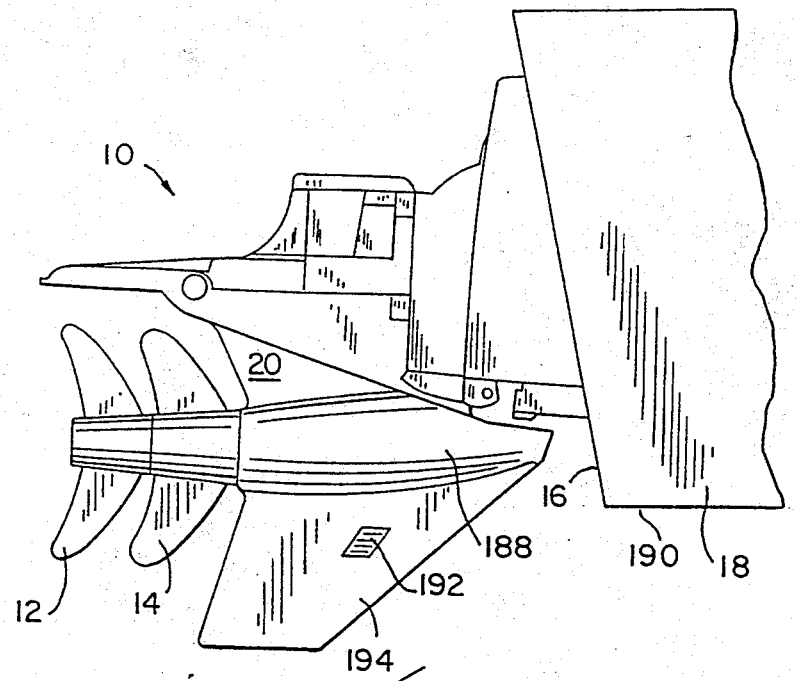
FIG. 1 is a side elevation view of a marine drive in accordance with the invention.

FIG. 1 shows a marine drive 10 having two counter-rotating surface operating propellers 12 and 14. The drive is mounted to the transom 16 of a boat 18 in the usual manner for a stern drive. The drive includes a housing 20, FIG. 2, having upper and lower spaced horizontal bores 22 and 24, and an intersecting vertical bore 26 extending therebetween. An upper input shaft 28 is in upper horizontal bore 22 and is coupled through a universal joint 30 to an input shaft 32 driven by the engine (not shown) in the boat. The universal joint enables trimming and steering of the drive. The input shaft drives an upper gear assembly 34 which is known in the art, for example as shown in U.S. Pat. Nos. 4,630,719, 4,679,682, and 4,869,121, incorporated herein by reference. A downwardly extending driveshaft 36 in vertical bore 26 is driven by input shaft 28 through upper gear assembly 34 operatively connected therebetween. Input gear 38 on shaft 28 rotates about a horizontal axis and drives gears 40 and 42 to rotate in opposite directions about a vertical axis. Shift and clutch assembly 44 causes engagement of one or the other of gears 40 and 42, to in turn cause rotation of driveshaft 36 in one or the other direction, to provide forward or reverse operation, all as in the noted incorporated patents.

Figure 3:
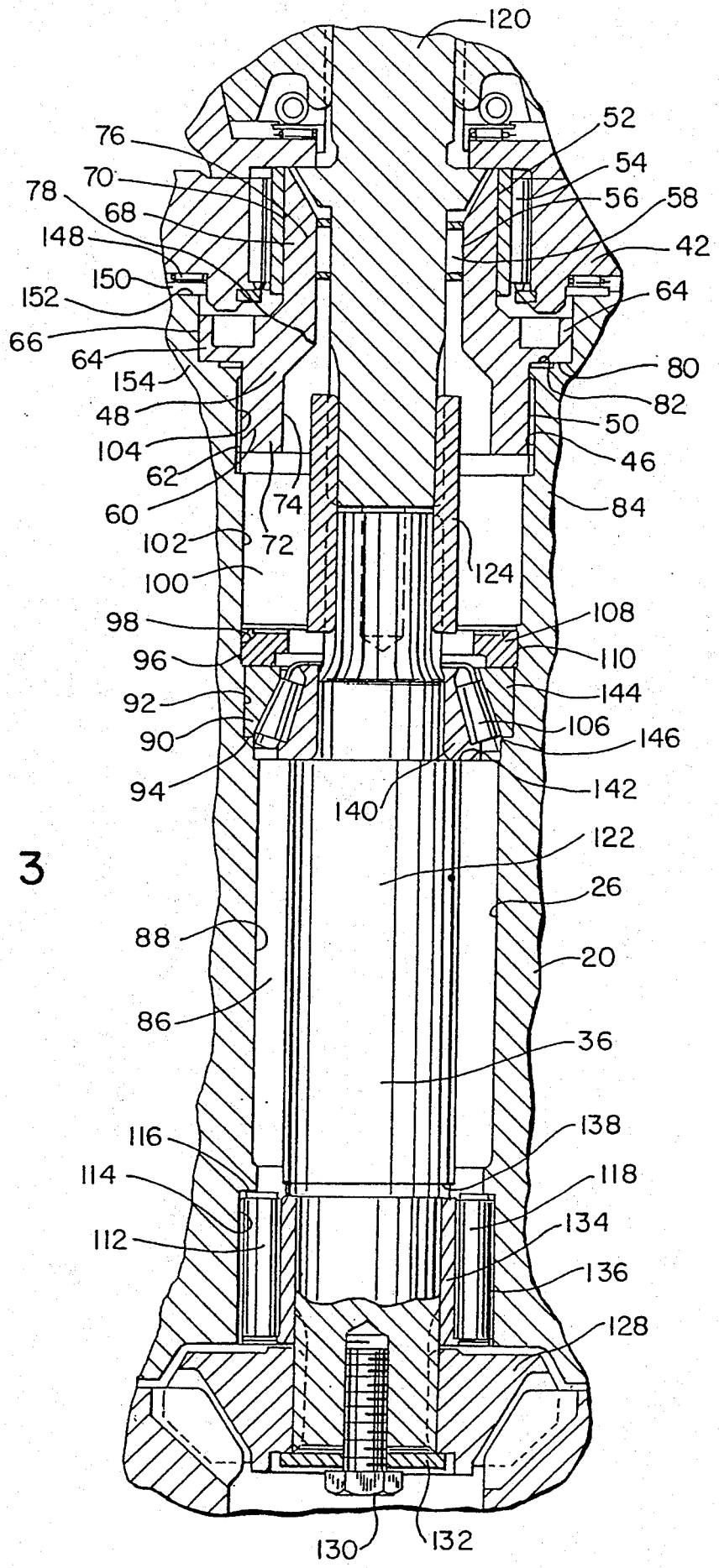
FIG. 3 is an enlarged view of a portion of the structure of FIG. 2.

Vertical bore 26 has an upper threaded portion 46, FIG. 3. An upper adaptor spool 48 has a lower threaded outer portion 50 mating with threaded portion 46 of vertical bore 26 and supporting gear 42 for rotation about driveshaft 36. Adaptor spool 48 has an upper outer surface 52 supporting an upper outer needle bearing 54 which supports gear 42 for rotation about adaptor spool 48. Adaptor spool 48 has an upper inner surface 56 supporting an upper inner needle bearing 58 which supports driveshaft 36 for rotation in adaptor spool 48.

Adaptor spool 48 has a lower outer section 60, FIG. 3, of a first outer diameter 62 and threaded as noted at 50 and mating with upper threaded portion 46 of vertical bore 26. Adaptor spool 48 has a central outer section 64 above lower outer section 60 and of a central outer diameter 66 larger than lower outer diameter 62. Adaptor spool 48 has an upper outer section 68 above central outer section 64 and of an upper outer diameter 70 less than central outer diameter 66 and less than lower outer diameter 62. Adaptor spool 48 has a lower inner section 72 of a lower inner diameter 74 within vertical bore 26. Adaptor spool 48 has an upper inner section 76 above lower inner section 72 and of an upper inner diameter 78 less than lower inner diameter 74. Upper outer needle bearing 54 is between gear 42 and upper outer section 68 of adaptor spool 48 and supports gear 42 for rotation about adaptor spool 48. Upper inner needle bearing 58 is between driveshaft 36 and upper inner section 76 of adaptor spool 48 and supports driveshaft 36 for rotation in adaptor spool 48. Lower outer section 60 and central outer section 64 of adaptor spool 48 meet at a downwardly facing annular shoulder 80 at the top end 82 of housing sidewall 84 forming vertical bore 26. Upper outer diameter 70 is substantially equal to lower inner diameter 74 of adaptor spool 48.

Figure 4:
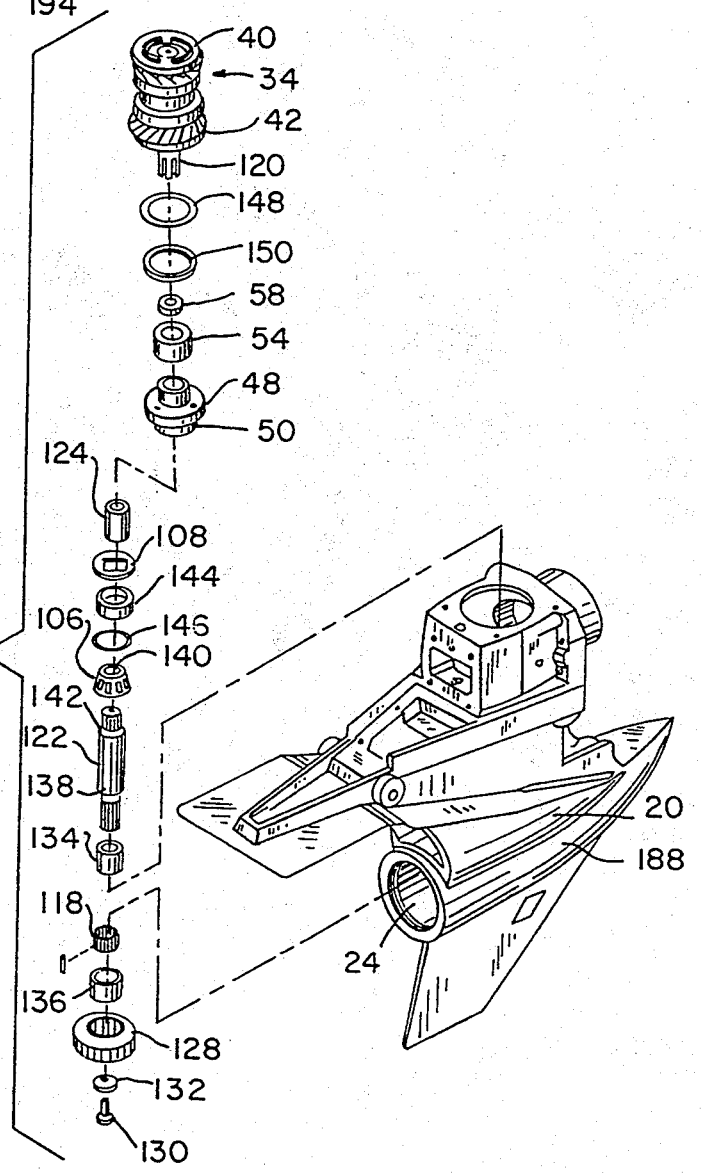
FIG. 4 is an exploded perspective view of a portion of the structure of FIG. 1.

Vertical bore 26 has a first section 86, FIG. 3, of a first inner diameter 88. Vertical bore 26 has a second section 90 above first section 86 and of a second inner diameter 92 larger than inner diameter 88. Sections 86 and 90 meet at an upwardly facing annular shoulder 94. Vertical bore 26 has a first thread 96 above second section 90 and of an inner diameter 98 at least as great as second inner diameter 92. Vertical bore 26 has a third section 100 above first thread 96 and of a third inner diameter 102 greater than second inner diameter 98. Vertical bore 26 has a second thread, provided by the noted thread 46, above third section 100 and of an inner diameter 104 at least as great as third inner diameter 102. A central tapered roller thrust bearing 106 is seated against shoulder 94 of vertical bore 26. An annular ring 108 has a threaded outer portion 110 mating with thread 96 of vertical bore 26 and retains bearing 106 against shoulder 94. Vertical bore 26 has a fourth section 112 below first section 86 and of a fourth inner diameter 114 larger than first inner diameter 88. First and fourth sections 86 and 112 meet at a downwardly facing annular shoulder 116. A lower needle bearing 118 is seated against downwardly facing shoulder 116 and supports driveshaft 36 for rotation. Central and upper bearings 106 and 58 are inserted into vertical bore 26 from above, FIG. 4. Lower bearing 118 is inserted into vertical bore 26 from below.

Driveshaft 36, FIG. 3, is a two piece member formed by an upper driveshaft segment 120 and a lower driveshaft segment 122 coupled by a sleeve 124 in splined relation. Central bearing 106 and lower bearing 118 support the lower driveshaft segment 122. Upper bearing 58 supports the upper driveshaft segment 120. The upper driveshaft segment is also supported by another upper needle bearing 126, FIG. 2, as in the noted incorporated patents.

Driveshaft 36 has a lower pinion gear 128, FIG. 3, mounted thereto by bolt 130 and washer 132. Needle bearing 118 is above pinion gear 128 and is supported between inner and outer races 134 and 136. Outer race 136 engages shoulder 116, and inner race 134 engages shoulder 138 on lower driveshaft segment 122. Bearing 106 has an inner race 140 engaging shoulder 142 on lower driveshaft segment 122. Bearing 106 has an outer race 144 stopped against shoulder 94 in bore 26. One or more shims 146 may be provided between outer race 144 and shoulder 94 to adjust axial positioning if desired. Gear 42 rotates on bearing 148 on race 150 seated on shoulder 152 of housing sidewall 154.

Figure 2:
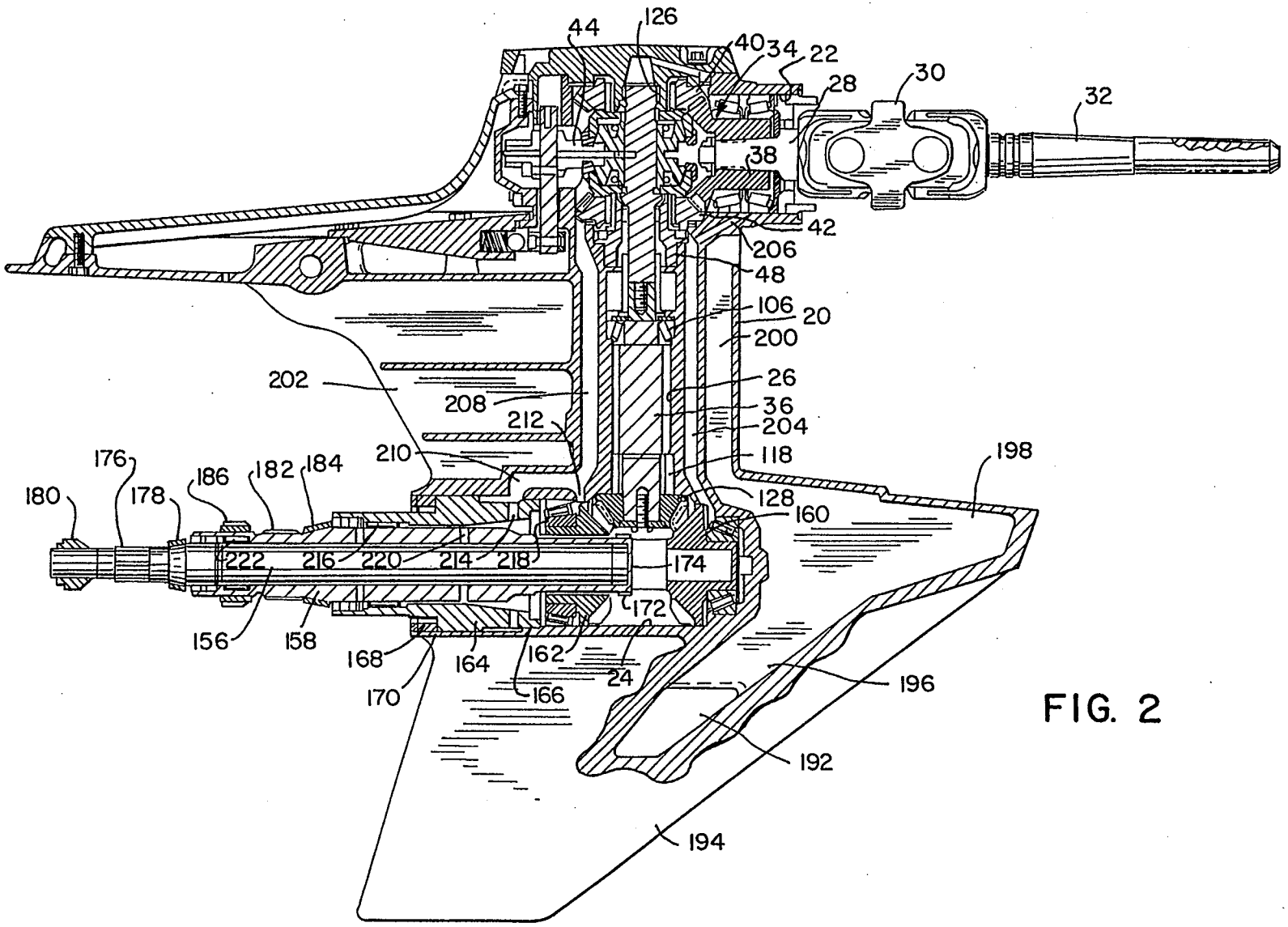
FIG. 2 is a partial sectional view of a portion of the structure of FIG. 1.

A pair of lower concentric counter-rotating inner and outer propeller shafts 156 and 158, FIG. 2, in lower horizontal bore 24 are driven by driveshaft 36. Inner propeller shaft 156 has a fore gear 160 driven by pinion gear 128 to drivingly rotate inner propeller shaft 156. Outer propeller shaft 158 has an aft gear 162 driven by pinion gear 128 to drivingly rotate outer propeller shaft 158 in the opposite rotational direction than inner propeller shaft 156. Reference is made to allowed incorporated U.S. application Ser. No. 07/889,530, filed May 27, 1992. The dual propeller shaft assembly is mounted in horizontal bore 24 by a spool assembly 164 at right hand threads 166 and retaining ring 168 having left hand threads 170. The right hand threads prevent right hand rotational loosening of the spool assembly, and the left hand threads 170 prevent left hand rotational loosening of the spool assembly. Forward thrust is transferred from the outer propeller shaft 158 to the inner propeller shaft 156 at thrust bearing 172 against annular shoulder 174 on inner propeller shaft 156. Propeller 12 is mounted on inner propeller shaft 156 in splined relation at 176 between tapered ring 178 and threaded nut 180. Propeller 14 is mounted on outer propeller shaft 158 in splined relation at 182 between tapered ring 184 and threaded nut 186.

The vertical distance between adaptor spool 48 and lower bearing 118 is about equal to the radius of propellers 12 and 14. Lower horizontal bore 24 of housing 20 is in the portion commonly called the torpedo 188, FIGS. 1 and 4. Torpedo 188 is slightly above the bottom 190 of boat 18 and hence is slightly above the surface of the water, thus reducing drag. This raising of the torpedo above the surface of the water is accomplished without a like raising of the engine in the boat nor the usual transom mounting location for the drive. In the preferred embodiment, the engine is raised 2 to 3 inches above its standard location. Housing 20 is a one-piece unitary integrally cast housing replacing prior two piece housings. Propeller shafts 156, 158 are spaced from upper input shaft 28 by a distance along driveshaft 36 in the range of about 8 to 15 inches.

Cooling water for the engine is supplied through water intake 192 in skeg 194, and flows through skeg passage 196 and then through torpedo nose passage 198 and then through housing passage 200 to the engine in the usual manner. After cooling the engine, the water and engine exhaust are exhausted in the usual manner through an exhaust elbow and exhausted through the housing and discharged at exhaust outlet 202 above torpedo 188 and into the path of the propellers in the upper portion of their rotation, as in U.S. Pat. No. 4,871,334. Oil is circulated from the lower gears upwardly through passage 204 and passage 206 to the upper gears, and returned to the lower gears at passage 208 feeding passages 210 and 212. Oil is supplied from passage 210 through spool assembly passage 214 to bearings 216 and 218, and through outer propeller shaft passage 220 to bearing 222. Passage 212 supplies oil to the front of bearing 218. Central outer section 64 of adaptor spool 48 closes off oil passage 204, to divert flow to passage 206.

Skeg 194 extends downwardly from torpedo portion 188 of housing 20, and has a forward leading edge 288 with upper and lower ends 302 and 304, and an aft trailing edge 306 with upper and lower ends 308 and 310. Upper end 302 of leading edge 288 is spaced forwardly of lower end 310 of trailing edge 306 by a horizontal distance greater than the horizontal length of torpedo portion 188, for full rudder control. Upper end 302 of leading edge 288 is at the forward leading edge 278 of torpedo portion 188. Lower end 310 of trailing edge 306 is aft of the aft end 312 of torpedo portion 188. Lower end 304 of leading edge 288 is aft of the vertical axis of rotation 314 of vertical driveshaft 36. Upper end 308 of trailing edge 306 is aft of the lower end 304 of leading edge 288 and forward of the aft end 312 of torpedo portion 188.

Torpedo portion 188 has an upper zone 276 with the noted sharp leading edge 278, and a lower zone 270 with a forward portion meeting skeg 194 at line 272 from which skeg 194 extends forwardly to leading edge 288 at upper end 302. Leading edge 278 of the upper zone of the torpedo portion extends downwardly and rearwardly at an angle 280 relative to vertical. Line 272 extends downwardly and rearwardly from point 284 of leading edge 278 at an initial angle 274 relative to vertical. Leading edge 288 of skeg 194 extends from point 284 of leading edge 278 of the torpedo portion downwardly and rearwardly at an angle 290 relative to vertical, which angle 290 is different than angle 280 and different than angle 274. During testing it was found that each of angles 280, 274 and 290 is preferably greater than about 15°, to prevent creep-up of water along respective edges 278, 272 and 288, to in turn reduce drag. In the preferred embodiment, angle 280 is about 21°, angle 274 is about 70°, and angle 290 is about 53°. Trailing edge 306 of skeg 194 extends from upper end 308 downwardly and rearwardly at an angle 316 relative to vertical. It is preferred that angle 316 be less than each of angles 280, 274, 290. In the preferred embodiment, angle 316 is about 16°.

Figure 5:
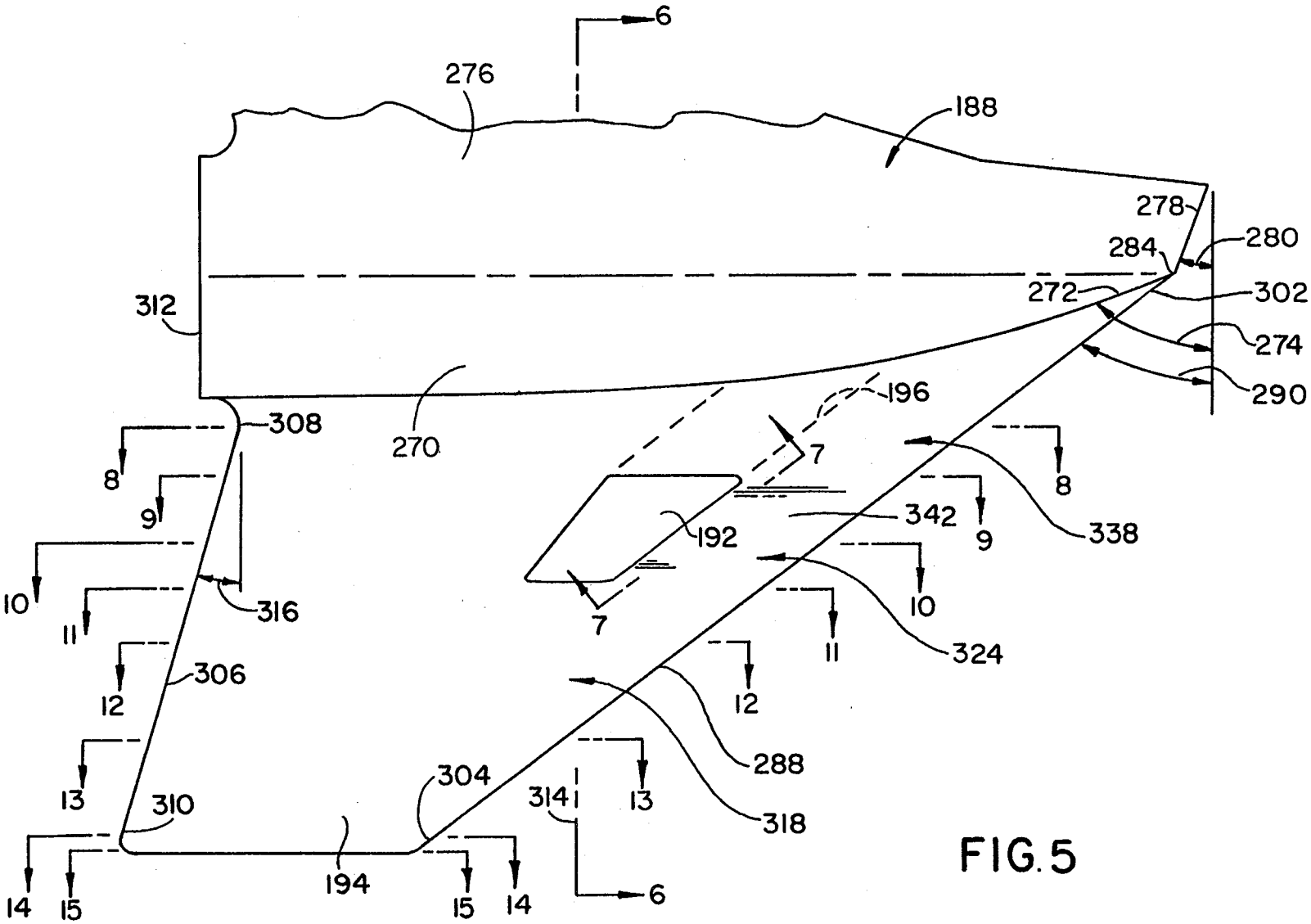
FIG. 5 is a side elevation view of a portion of the structure of FIG. 1.

Skeg 194 has a first lower zone 318 with outer surface profiles as shown in FIGS. 12–15 at 12P, 13P, 14P, 15P, along horizontal cross-sections, FIG. 5. Outer surface profiles 12P–15P are continuous along first zone 318 and define continuous right and left skeg sidewalls 320 and 322 therealong. Skeg 194 has a second zone 324, FIG. 5, above first zone 318 and with outer surface profiles shown in FIGS. 9–11 at 9P, 10P, 11P, along horizontal cross-sections, FIG. 5. Outer surface profiles 9P–11P along second zone 324 are discontinuous as shown at discontinuities 326, 328, 330, and defining the noted skeg sidewalls with water intake openings 192, 193 therein. Not only do the outer surface profiles 9P, 10P, 11P have respective discontinuities 326, 328, 330 therein, but also the horizontal cross-sections along second zone 324 have discontinuous gaps 332, 334, 336 therein defining cored passage 196 within skeg 194 communicating with openings 192, 193. Skeg 194 has a third zone 338, FIG. 5, above second zone 324 and with outer surface profiles as shown at 8P in FIG. 8 along horizontal cross-sections, FIG. 5. Outer surface profiles 8P along third zone 338 are continuous and define continuous skeg sidewalls along third zone 338; however, the horizontal cross-sections along third zone 338 have gaps therein as shown at 340, FIG. 8, defining the continuation of cored passage 196 upwardly within skeg 194 and communicating with torpedo portion 188 at torpedo nose passage 198, FIG. 2.

Figure 7:
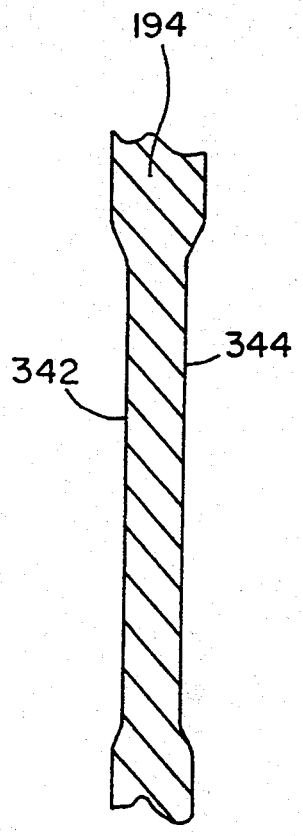
FIG. 7 is a sectional view taken along line 7—7 of FIG. 5.
Figures 8, 9, 10, 11, 12, 13, 14, 15, 16:
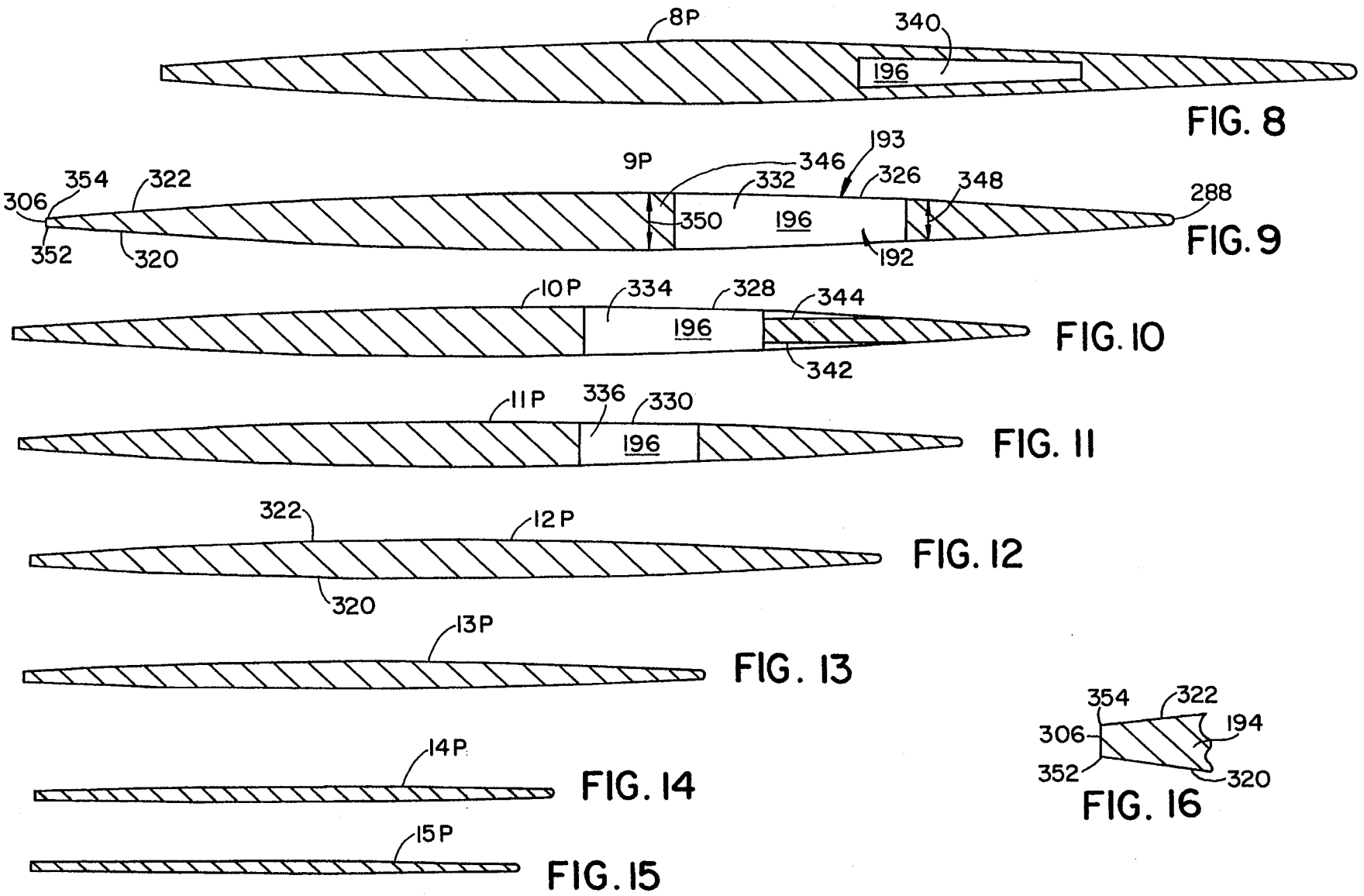
FIG. 8 is a sectional view taken along line 8—8 of FIG. 5.
FIG. 9 is a sectional view taken along line 9—9 of FIG. 5.
FIG. 10 is a sectional view taken along line 10—10 of FIG. 5.
FIG. 11 is a sectional view taken along line 11—11 of FIG. 5.
FIG. 12 is a sectional view taken along line 12—12 of FIG. 5.
FIG. 13 is a sectional view taken along line 13—13 of FIG. 5.
FIG. 14 is a sectional view taken along line 14—14 of FIG. 5.
FIG. 15 is a sectional view taken along line 15—15 of FIG. 5.
FIG. 16 is an enlarged view of a portion of the structure of FIG. 9.

Outer surface profiles 9P–11P, FIGS. 9–11, along second zone 324, FIG. 5, include ramp portions 342, 344, FIGS. 5, 7 and 10, forward of the discontinuity 328 at openings 192, 193. Ramp portions 342, 344 decrease the cross sectional width of skeg 194 immediately forward of discontinuity 328 in the outer surface profile.

Figure 6:
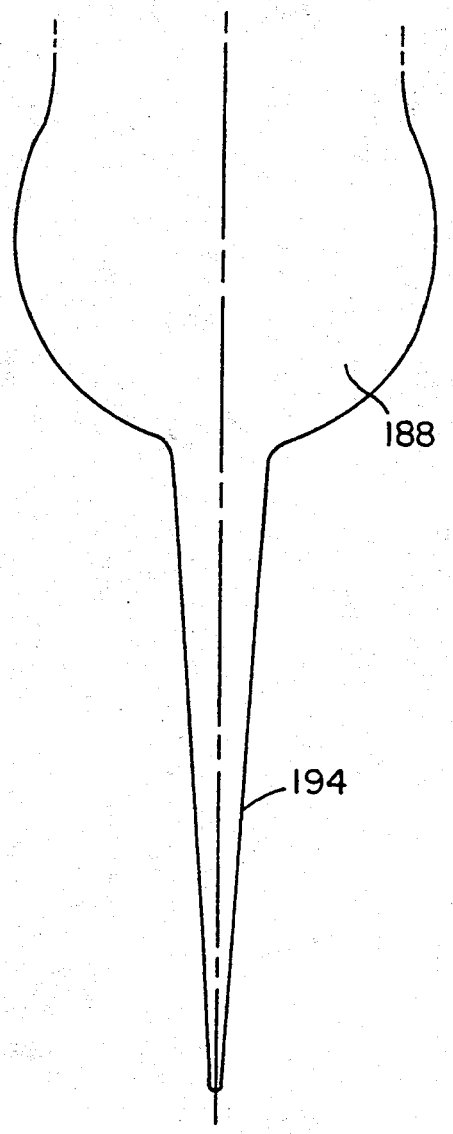
FIG. 6 is a profile view taken along line 6—6 of FIG. 5.

The horizontal cross-sections, particularly those in the second and third zones 324 and 338, have increasing cross sectional width from the leading edge 288 of the skeg to a central portion 346, FIG. 9, of the skeg, and then decrease in cross sectional width from central portion 346 to trailing edge 306 of the skeg. Discontinuity 326 in the outer surface profile 9P along second zone 324 occurs during increasing cross sectional widths, such that the cross sectional width 348 at the forward end of the discontinuity is narrower than the cross sectional width 350 at the aft end of the discontinuity. The lateral cross sectional width of skeg 194 is tapered top to bottom, FIG. 6, and is made as thin as possible, for reduced drag, yet thick enough to accommodate cored water passage 196. In the embodiment shown, the lateral cross sectional width at 346, FIG. 9, is about 0.693 inch, which cross sectional width tapers down to about 0.162 inch in FIG. 15.

Right and left skeg sidewalls 320 and 322, FIG. 9, extend from leading edge 288 rearwardly to respective right and left sharp trailing edges 352 and 354, FIG. 16, providing a sharp break-off releasing water flowing therepast and minimizing water curving back therearound including at the surface below the propeller hubs.

It is recognized that various equivalents, alternatives and modifications are possible within the scope of the appended claims.

We claim:

1. A marine drive for propelling a boat comprising:

a housing having upper and lower spaced generally horizontal bores and an intersecting generally vertical bore extending therebetween;

an upper input shaft in said upper horizontal bore;

a downwardly extending driveshaft in said vertical bore and driven by said input shaft;

a pair of lower concentric counter-rotating propeller shafts in said lower horizontal bore and driven by said driveshaft;

a pair of counter-rotating surface operating propellers each mounted to a respective one of said propeller shafts;

said housing comprising a lower generally horizontal torpedo portion around said lower horizontal bore, and a skeg extending downwardly from said torpedo portion, said skeg having a forward leading edge with upper and lower ends, and an aft trailing edge with upper and lower ends, wherein the upper end of said leading edge is spaced forwardly of the lower end of said trailing edge by a horizontal fore to aft distance greater than the horizontal fore to aft length of said torpedo portion, said torpedo portion having a leading edge extending from an upper end downwardly and rearwardly to a lower end, said upper end of said leading edge of said skeg meeting said lower end of said leading edge of said torpedo portion, said leading edge of said skeg extending downwardly and rearwardly from said lower end of said leading edge of said torpedo portion, the horizontal fore to aft distance between said upper end of said leading edge of said torpedo portion and said upper end of said leading edge of said skeg being less than the horizontal fore to aft distance between the aft end of said torpedo portion and said lower end of said trailing edge of said skeg.

2. The invention according to claim 1 wherein said lower end of said leading edge of said skeg is aft of the vertical axis of said driveshaft.

3. The invention according to claim 1 wherein said upper end of said trailing edge of said skeg is forward of the aft end of said torpedo portion.

4. The invention according to claim 1 wherein said leading edge of said torpedo portion extends downwardly and rearwardly at a first angle relative to a vertical line parallel to said driveshaft, said leading edge of said skeg extends downwardly and rearwardly at a second angle relative to said vertical line, said trailing edge of said skeg extends downwardly and rearwardly at a third angle relative to said vertical line, and wherein said second angle is greater than each of said first and third angles.

5. The invention according to claim 4 wherein said first angle is greater than 15°.

6. The invention according to claim 5 wherein said third angle is at least 15° and is less than said first angle.

7. The invention according to claim 1 wherein said skeg has a first zone with outer surface profiles along horizontal cross-sections, said outer surface profiles being continuous along said first zone and defining continuous skeg sidewalls therealong, said skeg has a second zone above said first zone and with outer surface profiles along horizontal cross-sections, said outer surface profiles along said second zone being discontinuous and defining skeg sidewalls with an opening therein, said horizontal cross-sections along said second zone having discontinuous gaps therein defining a cored passage within said skeg communicating with said openings in said sidewalls.

8. The invention according to claim 7 wherein said skeg has a third zone above said second zone and with outer surface profiles along horizontal cross-sections, said outer surface profiles along said third zone being continuous and defining continuous skeg sidewalls along said third zone, said horizontal cross-sections along said third zone having gaps therein defining the continuation of said cored passage upwardly within said skeg and communicating with said torpedo portion.

9. The invention according to claim 7 wherein said outer surface profiles along said second zone include ramp portions forward of the discontinuity at said openings, which ramp portions decrease the cross sectional width of said skeg immediately forward of the discontinuity in the outer surface profile.

10. The invention according to claim 7 wherein said horizontal cross-sections along said second zone have increasing cross sectional width from said leading edge of said skeg to a central portion of said skeg, and then decreasing cross sectional width from said central portion of said skeg to said trailing edge of said skeg, and wherein said discontinuity in said outer surface profile along said second zone occurs during said increasing cross sectional widths, such that the cross sectional width at the forward end of the discontinuity is narrower than the cross sectional width at the aft end of the discontinuity.

* * * * *